US011506030B2

(12) United States Patent
Shelton

(10) Patent No.: US 11,506,030 B2
(45) Date of Patent: Nov. 22, 2022

(54) PERFORATING GUN SYSTEM

(71) Applicant: Harrison Jet Guns II, L.P., Kennedale, TX (US)

(72) Inventor: James F. Shelton, Kennedale, TX (US)

(73) Assignee: HARRISON JET GUNS II, L.P., Kennedale, TX (US)

( * ) Notice: Subject to any disclaimer, the term of this patent is extended or adjusted under 35 U.S.C. 154(b) by 0 days.

(21) Appl. No.: 17/504,640

(22) Filed: Oct. 19, 2021

(65) Prior Publication Data

US 2022/0120165 A1 Apr. 21, 2022

Related U.S. Application Data

(60) Provisional application No. 63/093,436, filed on Oct. 19, 2020.

(51) Int. Cl.

| | |
|---|---|
| ***E21B 43/117*** | (2006.01) |
| ***E21B 43/116*** | (2006.01) |
| *E21B 43/1185* | (2006.01) |

(52) U.S. Cl.

CPC ..... *E21B 43/117* (2013.01); *E21B 43/116* (2013.01); *E21B 43/1185* (2013.01)

(58) Field of Classification Search

CPC ..... E21B 43/116; E21B 29/02; E21B 43/117; E21B 43/1185; E21B 43/119; E21B 43/263; F42B 1/02; F42D 1/08; F42D 1/22

See application file for complete search history.

(56) References Cited

U.S. PATENT DOCUMENTS

| | | | | |
|---|---|---|---|---|
| 10,794,159 | B2 * | 10/2020 | Eitschberger | E21B 23/10 |
| 2012/0247769 | A1 | 10/2012 | Schacherer et al. | |
| 2013/0043074 | A1 | 2/2013 | Tassaroli | |
| 2017/0115102 | A1 | 4/2017 | Knight et al. | |
| 2019/0330961 | A1 | 10/2019 | Knight et al. | |
| 2020/0024935 | A1 * | 1/2020 | Eitschberger | E21B 43/1185 |
| 2021/0115766 | A1 * | 4/2021 | Sokolove | E21B 43/1185 |
| 2021/0222525 | A1 * | 7/2021 | Dyess | F42B 3/10 |

OTHER PUBLICATIONS

International Search Report for International Application No. PCT/US2021/055531 dated Jan. 18, 2022, 3 pages.

* cited by examiner

*Primary Examiner* — Yong-Suk (Philip) Ro
(74) *Attorney, Agent, or Firm* — Warner Norcross + Judd LLP

(57) ABSTRACT

An improved perforating gun is provided. The perforating gun includes an outer loading tube, an internal charge holder, an addressable switch housing, and a detonator housing. In some embodiments, the addressable switch housing and the detonator housing are separate components that are joined to the outer loading tube. In other embodiments, the addressable switch housing is integrally joined to a first portion of the internal charge holder and the detonator housing is integrally joined to a second portion of the internal charge holder. When detonated, a plurality of shaped charges create a plurality of perforations through a wellbore casing, the perforations being angularly offset from each other within a single perforation plane, optionally followed by a hydraulic fracturing stage.

20 Claims, 6 Drawing Sheets

PERFORATING GUN SYSTEM

TECHNICAL FIELD

The present invention relates to perforating gun systems for the fracture stimulation of wells. More particularly, the present invention relates to frac gun perforating systems having penetrating charges to generate entrance holes for fracture stimulation.

BACKGROUND

Perforating guns are downhole systems that fire shaped charges through a wellbore casing, perpendicular to the long axis of the perforating gun. When lowered into the wellbore on a wireline opposite a hydrocarbon formation, the gun is fired electrically. Each shaped charge includes an interior cone of material that, when detonated, collapses and is formed into a high-velocity jet that penetrates through the wellbore casing. The resulting perforations allow communication of fluids (oil or gas) to flow into the wellbore.

Perforating guns are typically manufactured from a steel body with opposing box ends having female threads. Tandems having male threads are threaded to one or both ends of each perforating gun in a gun string. In this fashion, multiple perforating guns can be connected end-to-end and simultaneously detonated within the wellbore.

In some operations, well completion includes treating the perforations with fracturing fluid. The fracturing fluid is pumped into the wellbore in stages at high pressure to produces fractures that reach a hydrocarbon formation. Wells with multiple hydraulic fractures are typically desired to economically extract hydrocarbons from shale reservoirs because of the inherent low permeability. Each hydraulic fracturing stage utilizes multiple perforating guns to generate perforation clusters at different intervals along the well. Typically, a perforating cluster may contain as few as one or as many as thirty or more perforations. This process is commonly referred to as "multi-stage" hydraulic fracturing.

Despite their widespread acceptance, there remains a continued need for improved perforating gun systems. In particular, there remains a continued need for improved perforating gun systems that provide a desired wellbore perforation pattern with holes of a generally uniform distribution, optionally for use with hydraulic fracturing treatments.

SUMMARY OF THE INVENTION

An improved perforating gun is provided. The perforating gun includes an outer loading tube, an internal charge holder, an addressable switch housing, and a detonator housing. In some embodiments, the addressable switch housing is integrally joined to a first portion of the internal charge holder and the detonator housing is integrally joined to a second portion of the internal charge holder. In other embodiments, the addressable switch housing and the detonator housing are separate components that are joined to the outer loading tube. When detonated, a plurality of shaped charges create a plurality of perforations through a wellbore casing, the perforations being angularly offset from each other within a single perforation plane, optionally followed by a hydraulic fracturing stage.

In one embodiment, the addressable switch housing includes a first shaped charge orienting end and a second shaped charge orienting end. The addressable switch housing is integrally joined to the first shaped charge orienting end, and the detonator housing is integrally joined to the second shaped charge orienting end. The first and second shaped charge orienting ends are joined at an interface and collectively define a plurality of shaped charge openings that are in alignment with openings in the outer loading tube. Each charge orienting end includes threaded female openings in alignment with corresponding through-holes in the outer loading tube for receiving a threaded bolt therein.

In another embodiment, the addressable switch housing and the detonator housing are separate from the internal charge holder and are joined to the outer loading tube. Each housing includes a spring element and a contact plate, the spring element biasing the contact plate in an axially outward direction. The addressable switch housing and the detonator housing also include a first portion inserted within the outer loading tube and a second portion extending axially outwardly therefrom. The first portion includes a cylindrical sidewall defining a fastener through-hole in alignment with respective fastener through-holes in the outer loading tube. The second portion houses the spring element and the contact plate. The second portion includes a cylindrical sidewall having an increased outer diameter and having multiple resilient clips for limiting the axial travel of the contact plate.

In these and other embodiments, the addressable switch housing includes a rectangular cavity for the addressable switch. The detonator is centrally positioned within the internal charge holder and extends into the detonator housing. When detonated, the explosive output of the detonator initiates a firing of the shaped charges radially outward. The shaped charges are seated within charge cavities, which are arranged about a longitudinal axis of the perforating gun. Because the charge cavities are in plane with each other, the perforation pattern includes a plurality of perforations within a single perforation plane.

In a further embodiment, a method is provided. The method includes lowering a perforating gun into a wellbore having a wellbore casing, the perforating gun including an outer loading tube, an internal charge holder including a plurality of shaped charges that are angularly offset from each other, an addressable switch housing having addressable switch therein, and a detonator housing having least a portion of a detonator therein, wherein the addressable switch housing and the detonator housing each include a spring element and a contact plate, the spring element biasing the contact plate in an axially outward direction. The method further includes detonating the charges for creating a plurality of perforations through the wellbore casing, wherein the plurality of perforations are angularly offset from each other within a single perforation plane, optionally followed with the introduction of a hydraulic fracking fluid through the newly formed perforations.

These and other features and advantages of the present invention will become apparent from the following description of the invention, when viewed in accordance with the accompanying drawings and appended claims.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Figure 1:
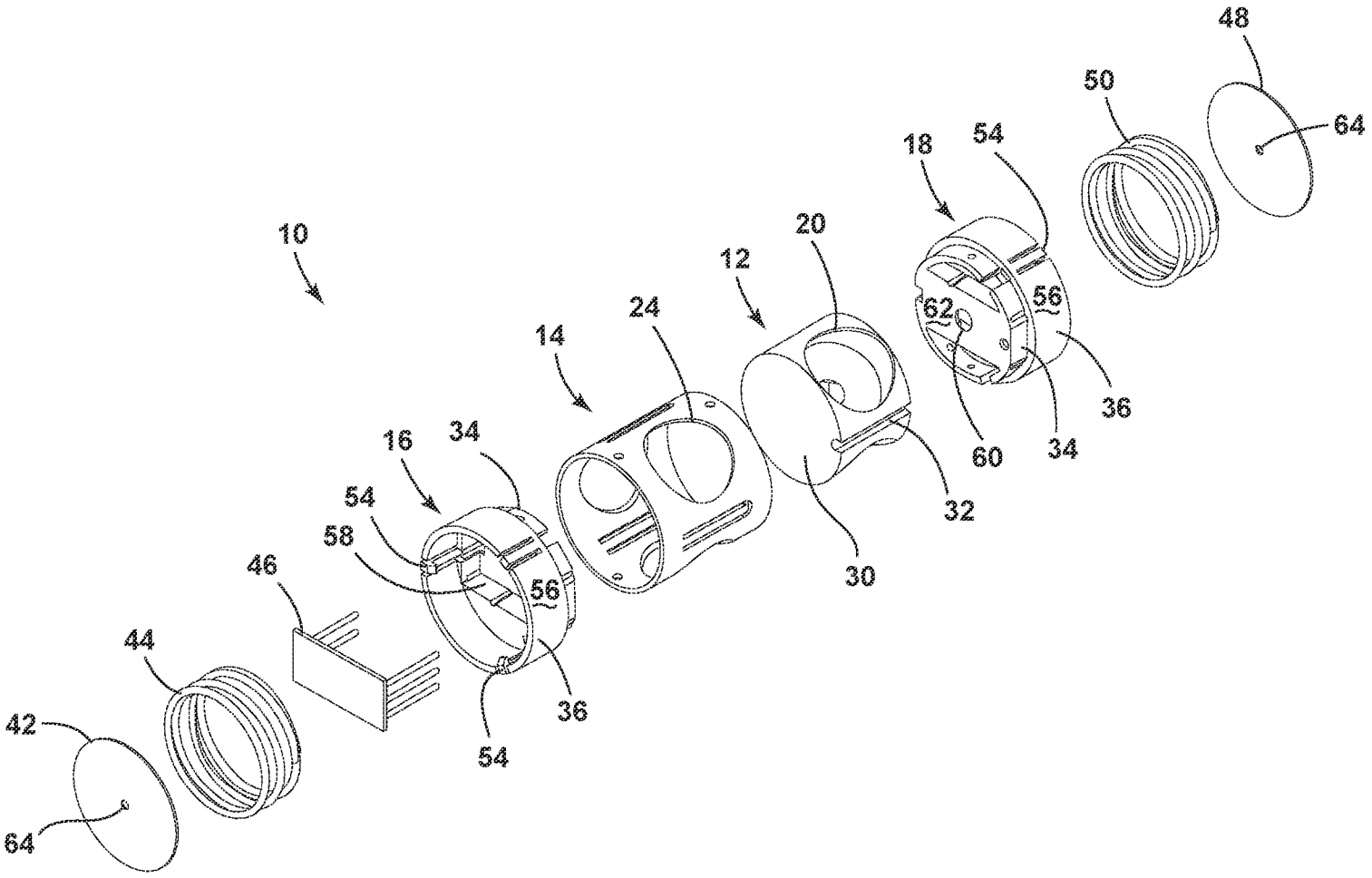
FIG. 1 is an exploded view of a perforating gun in accordance with a first embodiment of the present invention.
Figure 2:
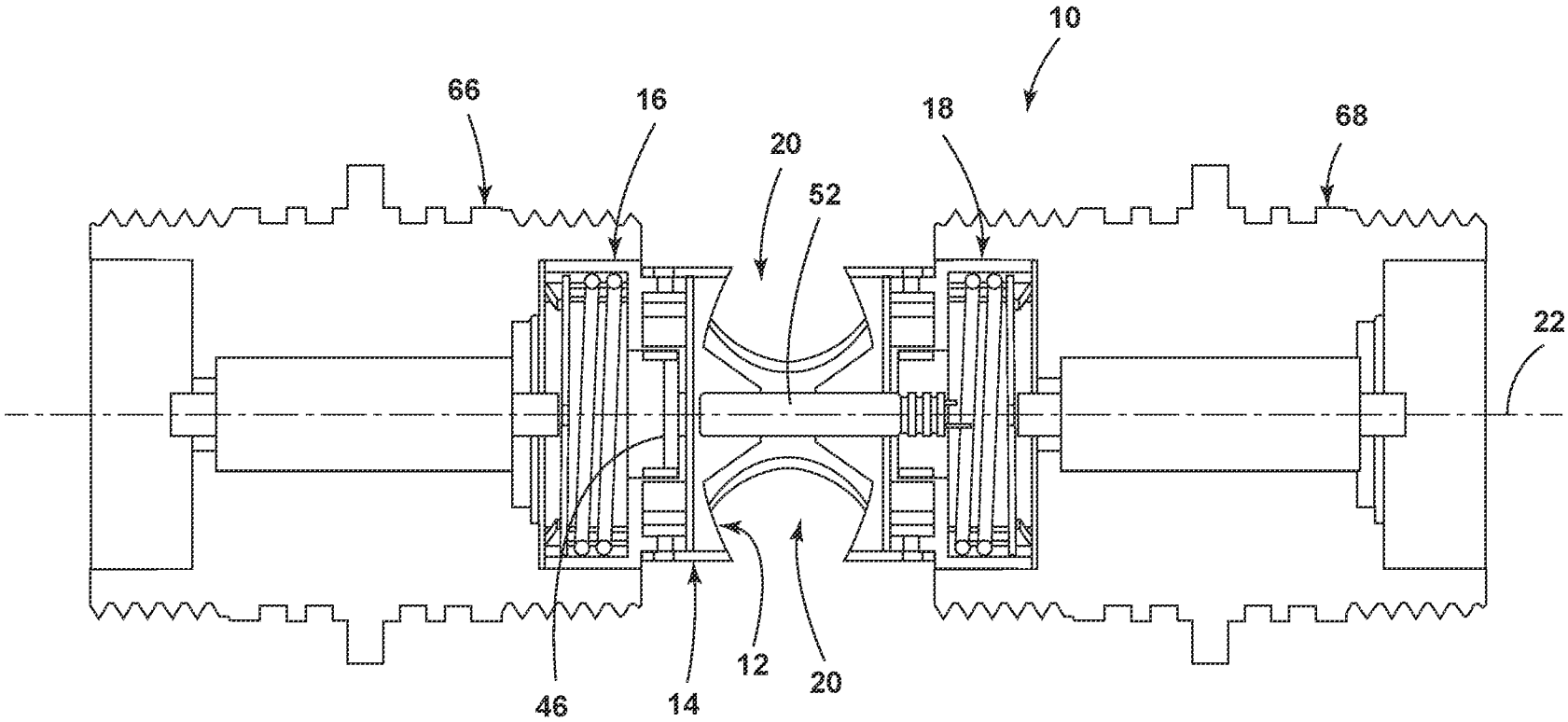
FIG. 2 is a cross-section of the perforating gun of FIG. 1.
Figure 3:
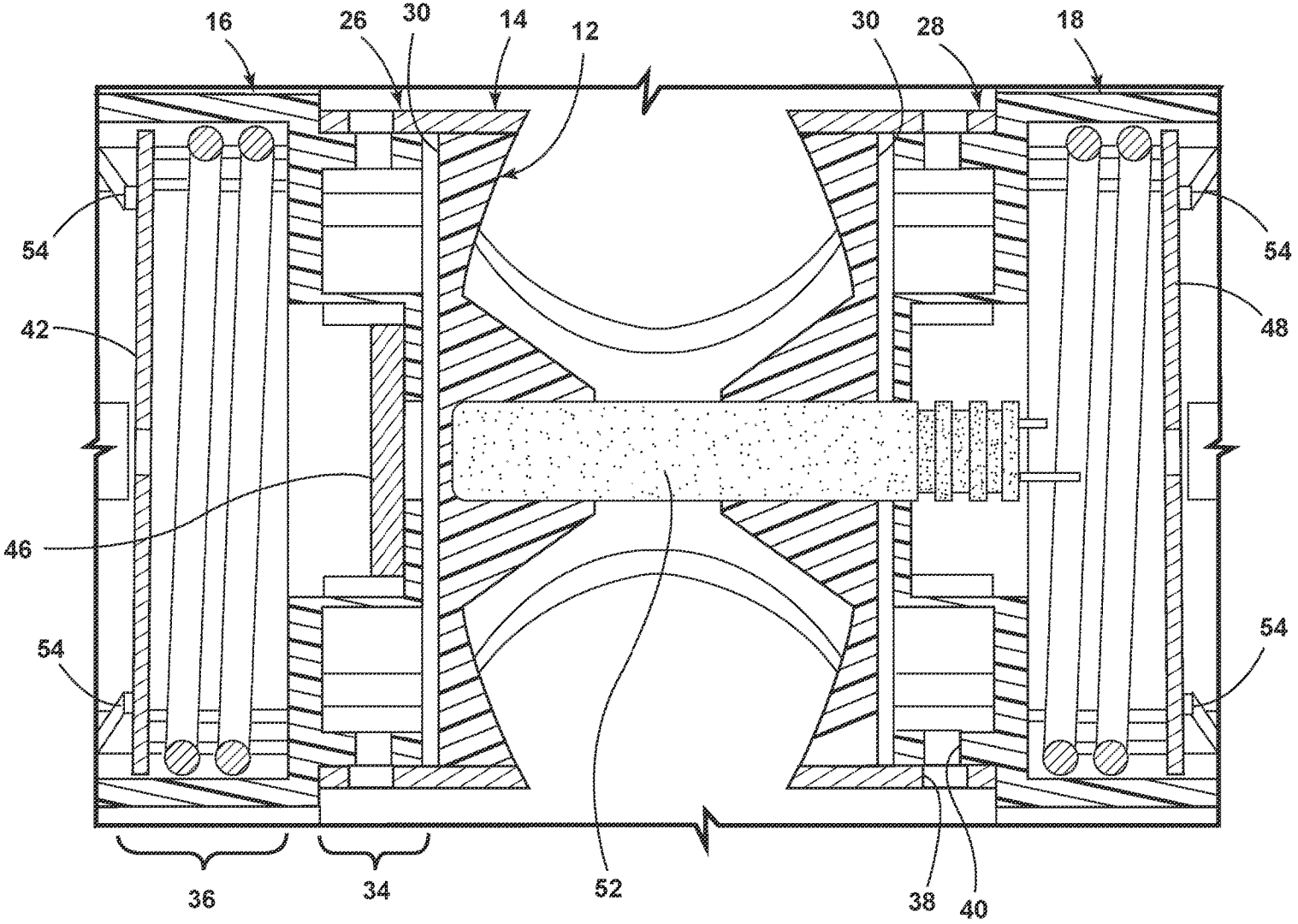
FIG. 3 is a close-up of the cross-section of FIG. 2.

Referring now to FIGS. 1-3, a perforating gun in accordance with one embodiment is illustrated and generally designated 10. The perforating gun 10 includes an internal charge holder 12, an outer loading tube 14, an addressable switch housing 16, and a detonator housing 18. The internal charge holder 12 is generally formed from plastic and includes a cylindrical body having multiple shaped charge openings 20 that receive a corresponding number of shaped charges. The openings 20 are angularly offset from each other and are optionally axially aligned with each other. Three openings 20 are arrayed about the longitudinal axis 22 of the perforating gun 10 in the illustrated embodiment, while other embodiments can include greater or fewer number of shaped charge openings 20.

As also shown in FIG. 1, the shaped charge openings 20 in the internal charge holder 12 are aligned with openings 24 in the outer loading tube 14. The outer loading tube 14 is generally cylindrical and includes a length that is greater than the length of the internal charge holder 12, such that opposing end portions 26, 28 of the outer loading tube 14 extend beyond the end walls 30 of the internal charge holder 12. The inner diameter of the outer loading tube 14 is approximately equal to the outer diameter of the internal charge holder 12, and rotational movement between the internal charge holder 12 and the outer loading tube 14 is prevented. The outer loading tube 14 is formed from stainless steel in the current embodiment, but can be formed from other materials in other embodiments. An axial channel 32 in the outer surface of the internal charge holder 12 allows the passage of wires through the perforating gun 10.

As noted above, the perforating gun 10 includes a switch housing 16 and a detonator housing 18. Each housing 16, 18 is made out of an electrically insulating material and is partially received within the outer loading tube 14. In particular, each housing 16, 18 includes a cylindrical construction having a first, small-diameter portion 34 and a second, large-diameter portion 36. The small-diameter portion 34 includes an outer diameter that is approximately equal to the outer diameter of the internal charge holder 12. The large-diameter portion 36 includes an outer diameter that greater than the outer diameter of the outer loading tube 14 as best shown in FIG. 3. Bolt openings 38 in the outer loading tube 14 align with bolt openings 40 in the small-diameter portion 34 of each housing 16, 18.

As also shown in FIG. 2, the switch housing 16 contains a first contact plate 42, a first compression spring 44, and an addressable switch 46, and the detonator housing 18 contains a second contact plate 48, a second compression spring 50, and a least portion of a detonator 52. The compression springs 44, 50 are seated within the larger-diameter portion of the respective housings 16, 18 and bear against the contact plates 42, 48. Each housing 16, 18 includes a plurality of resilient clips 54 (optionally three clips) for limiting axial travel of the contact plates 42, 48. The resilient clips 54 are integrally formed with the outer cylindrical sidewall 56 of the large-diameter portion 36, being flexible radially outwardly during assembly of the switch housing.

As shown in FIG. 1, the switch housing 16 includes a rectangular opening 58 for the addressable switch 46. The addressable switch 46 is in electrical communication with the detonator 52, which is centrally located within the internal charge holder 12. At least a portion of the detonator 52 extends through a circular opening 60 in the bottom face 62 of the detonator housing 18. Each contact plate 42, 48 includes a through-hole 64 for receiving a contact pin or electrical wiring. A first tandem 66 is joined to the first end of the perforating gun 10, and in particular the switch housing 16. A second tandem 68 is joined to the second end of the perforating gun, and in particular the detonator housing 18. Wiring signals pass through the second tandem 68 to the detonator 52, which is partially within the detonator housing 18.

Figure 4:
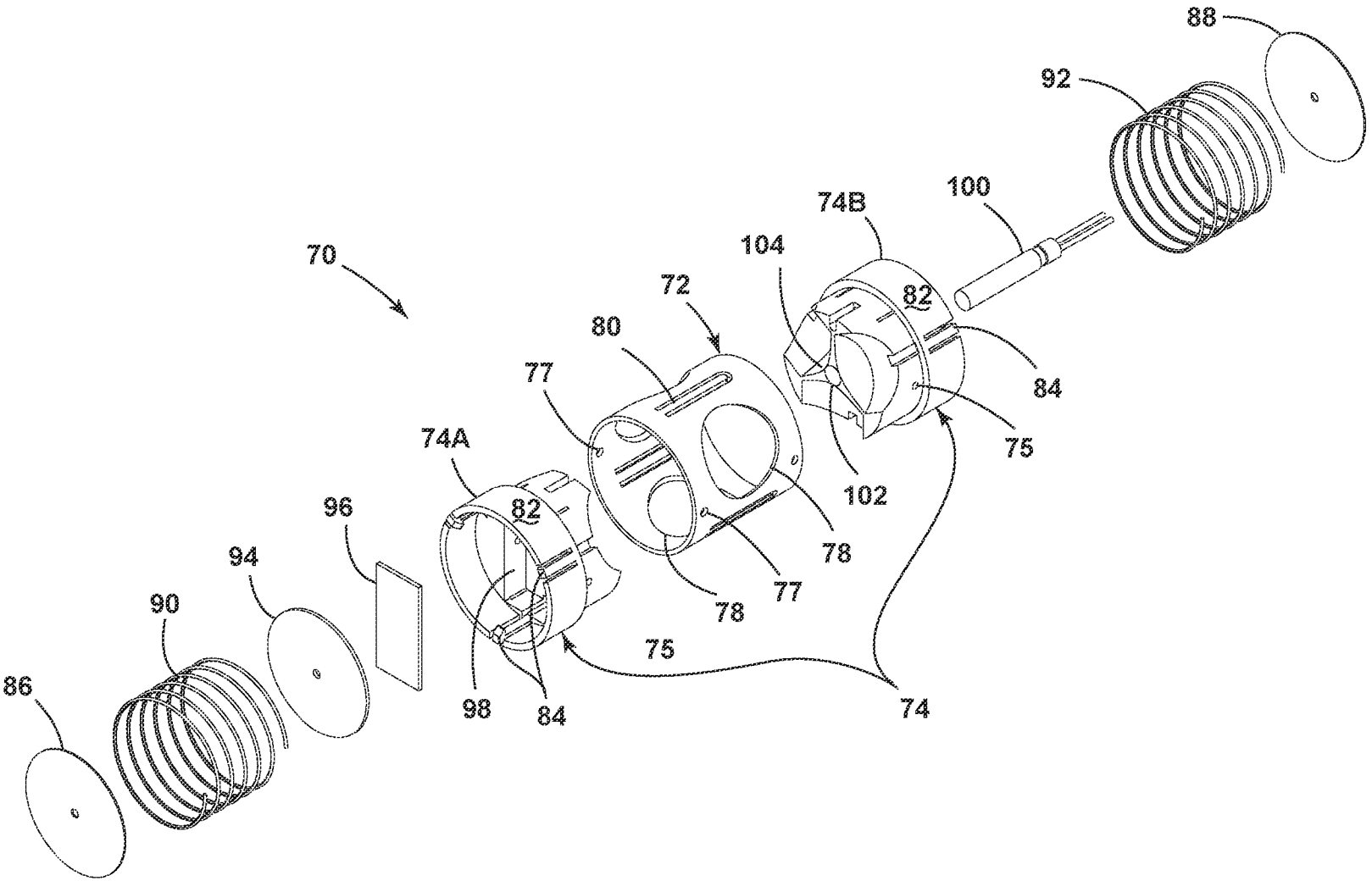
FIG. 4 is an exploded view of a perforating gun in accordance with a second embodiment of the present invention.
Figure 5:
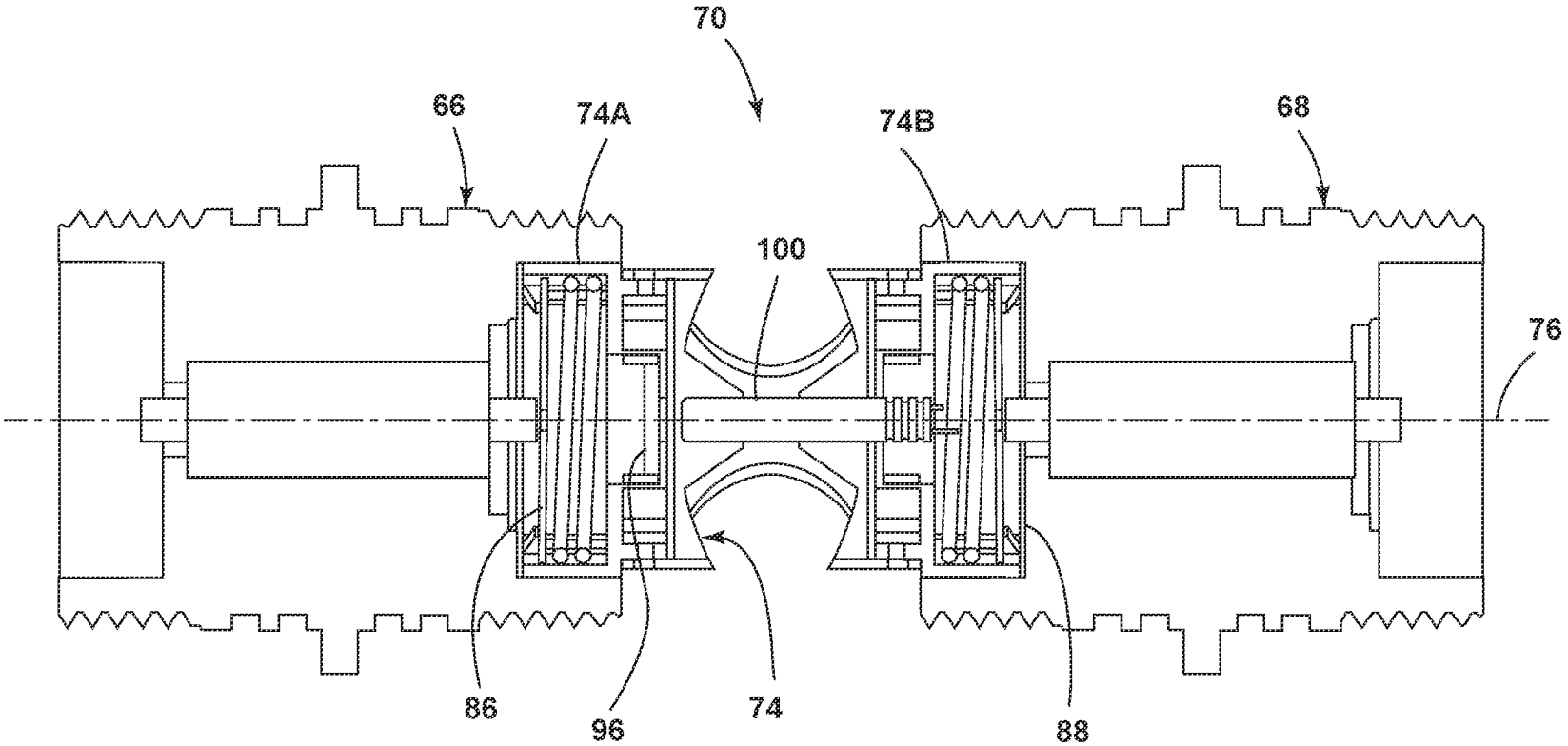
FIG. 5 is a cross-section of the perforating gun of FIG. 4.
Figure 6:
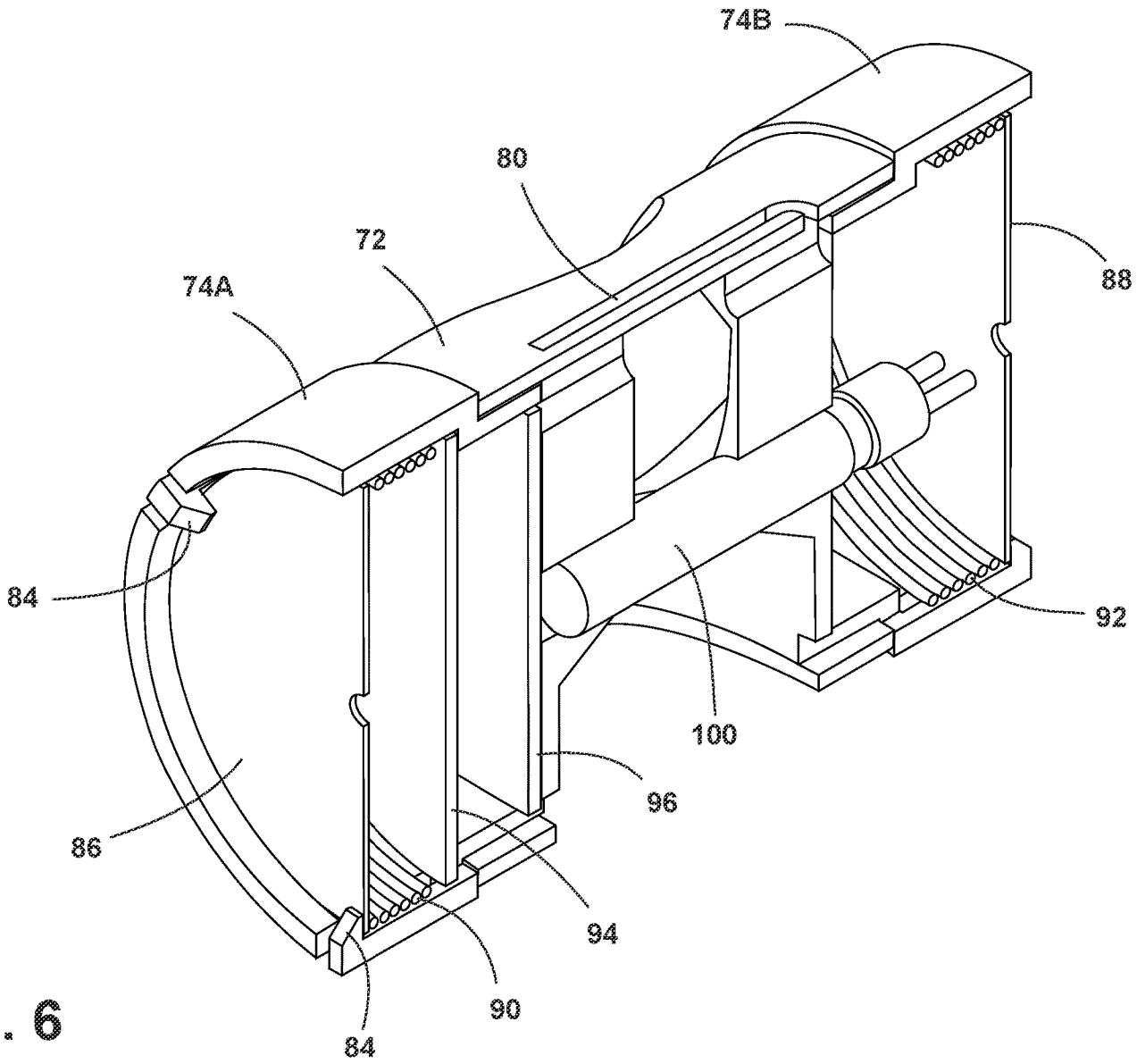
FIG. 6 is a close-up of the cross-section of FIG. 5.

Referring now to FIGS. 4-6, a perforating gun in accordance with a second embodiment is illustrated and generally designated 70. The perforating gun of FIGS. 4-6 is similar in structure and function to the perforating gun of FIGS. 1-3, except that the internal charge holder comprises a first charge orienting end and a second charge orienting end that are separable from each other and that are integrally joined to the addressable switch housing and the detonator housing, respectively.

More particular, the perforating gun 70 of FIGS. 4-6 includes an outer loading tube 72 and an internal charge carrier 74 separated into a first charge orienting end 74A and a second charge orienting end 74B. When joined together, the first and second charge orienting ends 74A, 74B form multiple charge openings that are arrayed about a longitudinal axis 76 of the perforating gun 70. Three openings are arrayed about the longitudinal axis 76 of the perforating gun 70 in the illustrated embodiment, while other embodiments can include greater or fewer number of openings. The shaped charge openings are aligned with openings 78 in the outer loading tube 72, similar to the embodiment of FIGS. 1-3 above. The first and second charge orienting ends 74A, 74B are optionally formed from plastic, and the outer loading tube 72 is optionally formed from a conductive material, for example stainless steel, having a plurality of grounding flanges 80 defined in its outer cylindrical sidewall. Each charge orienting end 74A, 74B includes two threaded female openings 75 in alignment with two through-holes 77 in the outer loading tube 72 for receiving a threaded bolt therein.

The first and second charge orienting ends 74A, 74B also include a cylindrical sidewall 82 having a plurality of resilient clips 84, optionally three clips. The resilient clips 84 are integrally formed with the outer cylindrical sidewall 82 to limit axial travel of respective first and second contact plates 86, 88. Each contact plate 86, 88 is formed from a conductive material and includes a through hole for receiving a contact pin or electrical wiring. The contact plates 86, 88 are biased outwardly by first and second compression springs 90, 92 which are also seated within the respective charge orienting ends 74A, 74B. The first charge orienting end 74A includes a further contact plate 94 that is seated opposite the first contact plate 94, separating the first compression spring 90 from the addressable switch 96. The addressable switch 96 is seated within a rectangular recess 98 in the first charge orienting end 74A. At least a portion of the detonator 100 extends through a circular opening 102 in the bottom face 104 of the second charge orienting end 74B.

Operation of the perforating gun is identical for both embodiments above. The detonator 52, 100, when ignited, will fire the shaped charges, creating a plurality of angularly offset perforations within a single perforation plane in a wellbore casing. The perforation plane includes three perforation jets in the illustrated embodiments, the perforation jets being angularly offset by 120 degrees about the longitudinal axis of the perforating gun 10. Other embodiments can include greater or fewer number of perforation jets, including four perforation jets that are angularly offset by 90 degrees, for example. Further by example, other embodiments can include N-number of perforations that are angularly offset by 360/N degrees. The perforation jets are orthogonal to the wellbore axis. An adjacent perforation gun can generate perforations that are in-phase or out-of-phase with the perforations generated by the perforating gun 10, 70. Detonation can be followed by a hydraulic fracturing treatment, which creates a hydrostatic pressure for fracturing the surrounding geologic formation in the radial direction for reaching a hydrocarbon formation.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

What is claimed is:

1. A perforating gun comprising:

an internal charge holder including a first charge orienting end and a second charge orienting end that cooperate to define a plurality of shaped charge openings that are angularly offset from each other;

an outer loading tube including a cylindrical body defining a plurality of through-holes in alignment with the plurality of shaped charge openings;

wherein the first charge orienting end includes an addressable switch housing for receiving an addressable switch therein;

wherein the second charge orienting end includes a detonator housing for receiving at least a portion of a detonator therein; and wherein the first charge orienting end and the second charge orienting end each include a spring element and a contact plate, the spring element biasing the contact plate axially outward, with each contact plate defining a central opening therein.

2. The perforating gun of claim 1 wherein the first charge orienting end and the second charge orienting end each include a cylindrical sidewall defining a plurality of resilient clips for limiting axial travel of the respective contact plate.

3. The perforating gun of claim 1 further including an addressable switch, wherein the first charge orienting end includes a rectangular recess for the addressable switch.

4. The perforating gun of claim 1 wherein the first charge orienting end and the outer loading tube each define a fastener through-hole in alignment with each other.

5. The perforating gun of claim 1 wherein the second charge orienting end and the outer loading tube each define a fastener through-hole in alignment with each other.

6. The perforating gun of claim 1 wherein the first and second charge orienting ends are formed from one or more non-conductive materials, and wherein the outer loading tube and the contact plates are formed from one or more electrically conductive materials.

7. A perforating gun comprising:

an outer loading tube including a first end opposite a second end;

an internal charge holder within the outer loading tube for receiving a plurality of shaped charges that are angularly offset from each other;

an addressable switch housing joined to the first end of the outer loading tube for receiving an addressable switch therein;

a detonator housing joined to the second end of the outer loading tube for receiving at least a portion of a detonator therein; and wherein the addressable switch housing and the detonator housing each include a first portion inserted within the outer loading tube and a second portion extending axially outwardly therefrom, the second portion including a spring element and a contact plate, the spring element biasing the contact plate in a direction away from the internal charge holder, with each contact plate defining a through-hole therein.

8. The perforating gun of claim 7 wherein the internal charge holder includes a plurality of shaped charge openings arranged about a longitudinal axis of the perforating gun, and wherein the outer loading tube includes a plurality of through-holes in alignment with the plurality of shaped charge openings in the internal charge holder.

9. The perforating gun of claim 7 wherein the spring element is a compression spring, and wherein the through-hole is centrally located within the contact plate.

10. The perforating gun of claim 7 wherein the addressable switch housing and the detonator housing each include a plurality of resilient clips for limiting axial travel of the respective contact plate.

11. The perforating gun of claim 7 further including a detonator, wherein a first portion of the detonator is housed within the internal charge holder and a second portion of the detonator extends into the detonator housing.

12. The perforating gun of claim 7 further including an addressable switch, wherein the first portion of the addressable switch housing includes a rectangular cavity for receiving the addressable switch therein.

13. The perforating gun of claim 7 wherein the first portion of the addressable switch housing includes a cylindrical sidewall defining a first fastener through-hole in alignment with a second fastener through-hole in the outer loading tube.

14. The perforating gun of claim 7 wherein the first portion of the detonator housing includes a cylindrical sidewall defining a first fastener through-hole in alignment with a second fastener through-hole in the outer loading tube.

15. A method comprising:

providing a perforating gun including an outer loading tube, an internal charge holder having a plurality of shaped charges that are angularly offset from each other, an addressable switch housing having addressable switch therein, and a detonator having least a portion of a detonator therein, wherein the addressable switch housing and the detonator housing each include a spring element that bias a contact plate in an axially outward direction;

positioning the perforating gun within a wellbore having a wellbore casing; and detonating the plurality of shaped charges for creating a plurality of perforations through the wellbore casing, wherein the plurality of perforations are angularly offset from each other within a single perforation plane.

16. The method of claim 15 wherein the plurality of perforations include N-number of perforations that are angularly offset from each other by approximately 360/N degrees.

17. The method of claim 15 further including providing a hydraulic fracking fluid through the plurality of perforations.

18. A self-positioning perforating gun system comprising:

a perforating gun; and first and second tandems joined to opposing ends of the perforating gun;

wherein the perforating gun includes:

an outer loading tube including a first end opposite a second end, an internal charge holder within the outer loading tube including a plurality of shaped charges that are angularly offset from each other, an addressable switch housing including an addressable switch therein, and a detonator housing including at least a portion of a detonator therein, wherein the addressable switch housing and the detonator housing each include a spring element and a contact plate, the spring element biasing the contact plate in an axially outward direction.

19. The system of claim 18 wherein the internal charge holder includes a first charge orienting end and a second charge orienting end, and wherein the addressable switch housing is integrally joined to the first charge orienting end and the detonator housing is integrally joined to the second charge orienting end.

20. The system of claim 18 wherein the addressable switch housing and the detonator housing are reach removably coupled to the internal charge holder on opposing ends thereof.

* * * * *